US009604151B2

(12) United States Patent
DeCaro et al.

(10) Patent No.: US 9,604,151 B2
(45) Date of Patent: Mar. 28, 2017

(54) WATER AMUSEMENT DEVICE

(71) Applicants: Charles E. DeCaro, Huron, OH (US); Richard D. Hughes, Norwalk, OH (US)

(72) Inventors: Charles E. DeCaro, Huron, OH (US); Richard D. Hughes, Norwalk, OH (US)

( * ) Notice: Subject to any disclaimer, the term of this patent is extended or adjusted under 35 U.S.C. 154(b) by 0 days.

(21) Appl. No.: 14/928,068

(22) Filed: Oct. 30, 2015

(65) Prior Publication Data

US 2016/0121227 A1 May 5, 2016

Related U.S. Application Data

(60) Provisional application No. 62/072,604, filed on Oct. 30, 2014.

(51) Int. Cl.

| | |
|---|---|
| ***A63G 31/00*** | (2006.01) |
| ***B05B 15/06*** | (2006.01) |
| *B05B 15/00* | (2006.01) |

(52) U.S. Cl.

CPC ..... *A63G 31/007* (2013.01); *B05B 15/061* (2013.01)

(58) Field of Classification Search

CPC ..... A63G 31/00; A63G 31/007; A63G 21/00; A63G 21/18; B05B 15/00; B05B 15/061

USPC ..... 472/116–117, 128; 104/69–70

See application file for complete search history.

(56) References Cited

U.S. PATENT DOCUMENTS

| | | | |
|---|---|---|---|
| 1,529,467 | A | 3/1925 | Davis et al. |
| 1,648,196 | A | 11/1927 | Rohmer |
| 3,141,670 | A | 7/1964 | Smyrni et al. |
| 3,170,171 | A | 2/1965 | Mayhew et al. |
| 3,231,269 | A | 1/1966 | Dalrymple, Jr. |
| 3,246,892 | A | 4/1966 | Grudoski |
| 3,363,268 | A | 1/1968 | Friedlander |
| 3,539,181 | A | 11/1970 | Larsen |
| 3,752,472 | A | 8/1973 | Snead |
| 3,866,916 | A | 2/1975 | Clarke |
| 4,057,244 | A | 11/1977 | Gaspar |
| 4,145,042 | A | 3/1979 | Becker et al. |
| 4,149,710 | A | 4/1979 | Rouchard |
| 4,243,220 | A | 1/1981 | Shelley |
| 4,505,897 | A | 3/1985 | Coy et al. |
| 4,548,357 | A | 10/1985 | Schmidt |
| 4,573,679 | A | 3/1986 | Janszen |
| 4,642,822 | A | 2/1987 | Tvengsberg |
| 4,786,088 | A | 11/1988 | Ziu |
| 4,799,665 | A | 1/1989 | Bracy |
| 4,805,897 | A | 2/1989 | Dubeta |
| 4,805,898 | A | 2/1989 | Jacober et al. |
| 4,961,535 | A | 10/1990 | Skibik |
| 5,194,048 | A | 3/1993 | Briggs |
| 5,213,547 | A | 5/1993 | Lochtefeld |
| 5,378,197 | A | 1/1995 | Briggs |

(Continued)

*Primary Examiner* — Kien Nguyen

(74) *Attorney, Agent, or Firm* — MacMillan, Sobanski & Todd, LLC

(57) ABSTRACT

A water amusement device includes a base pad that extends in a longitudinal direction and a lateral direction. A plurality of longitudinally-extending troughs is located on the base pad. Each longitudinally-extending trough has a respective channel opening that is connected to a laterally extending drain channel. A pad surface is located on the longitudinally-extending troughs and a water-distribution feature located on the pad surface.

20 Claims, 10 Drawing Sheets

(56) References Cited

U.S. PATENT DOCUMENTS

| | | | | |
|---|---|---|---|---|
| 5,385,472 | A | 1/1995 | Mullin | |
| 5,387,158 | A | 2/1995 | Bertrand | |
| 5,401,214 | A | 3/1995 | Smollar et al. | |
| 5,405,294 | A | 4/1995 | Briggs | |
| 5,480,336 | A | 1/1996 | Blanchard | |
| 5,503,597 | A | 4/1996 | Lochtefeld et al. | |
| 5,554,074 | A | 9/1996 | Von Parrish | |
| 5,662,525 | A | 9/1997 | Briggs | |
| 5,683,314 | A | 11/1997 | Musso | |
| 5,741,189 | A | 4/1998 | Briggs | |
| 5,820,471 | A | 10/1998 | Briggs | |
| 5,820,472 | A | 10/1998 | Briggs | |
| 5,967,901 | A | 10/1999 | Briggs | |
| 6,062,983 | A | 5/2000 | Butsook | |
| 6,089,987 | A | 7/2000 | Briggs | |
| 6,186,902 | B1 | 2/2001 | Briggs | |
| 6,210,287 | B1 | 4/2001 | Briggs | |
| 6,319,139 | B1 | 11/2001 | Tracy | |
| 6,375,578 | B1 | 4/2002 | Briggs | |
| 6,443,849 | B1 | 9/2002 | Byrd | |
| 6,569,023 | B1 | 5/2003 | Briggs | |
| 6,739,979 | B2 | 5/2004 | Tracy | |
| 6,786,830 | B2 | 9/2004 | Briggs et al. | |
| 6,849,031 | B2 | 2/2005 | Paci | |
| 7,178,534 | B2 | 2/2007 | Garman et al. | |
| 7,431,654 | B2 | 10/2008 | Ochi | |
| 7,568,859 | B2 | 8/2009 | McFarland | |
| 8,012,031 | B2 | 9/2011 | Stuart et al. | |
| 8,550,928 | B2 * | 10/2013 | Hamelin | A63G 31/007 239/17 |
| 8,821,304 | B2 | 9/2014 | Ensing | |
| 2005/0250588 | A1 * | 11/2005 | Dancer | B05B 1/20 472/128 |
| 2014/0263714 | A1 | 9/2014 | Chase et al. | |

* cited by examiner

WATER AMUSEMENT DEVICE

CROSS-REFERENCE TO RELATED APPLICATIONS

This application claims the benefit of U.S. Provisional Application No. 62/072,604, filed Oct. 30, 2014, the disclosure of which is incorporated herein by reference.

BACKGROUND OF THE INVENTION

This invention relates in general to a recreational water park. More specifically, this invention relates to a splash pad including one or more water spray features.

A splash pad is a water amusement device that allows users to play with water without requiring a full pool. Splash pads are often installed in places such as parks and resorts for the entertainment of guests. A conventional splash pad includes a concrete deck surface with a plurality of water distribution features attached thereto. The water distribution features will spray, dump, or otherwise emit water on users. Some water distribution features spray water upwardly from the deck surface, others rain or dump water from above the users' heads, while others allow the user to direct the flow of water.

A supply pump is connected to the water distribution features by plumbing. The supply pump provides water under pressure to each of the features in order to operate them. The plumbing is located below the deck surface so that it is out of the way of users and does not present a tripping hazard. The pressure of the water and the size of the pump will vary depending on the size, spacing, and what particular water distribution features are installed on the splash pad.

A conventional splash pad includes a drain that collects the water from the deck surface and transfers it to a reservoir. The water in the reservoir may be filtered and drawn by the supply pump to transfer back to the water-distribution features. This allows the splash pad to be operated with less water than would be required if a continuous supply of clean water were used. It would be advantageous to have an improved way to install a splash pad.

SUMMARY OF THE INVENTION

This invention relates to a water amusement device. The water amusement device includes a base pad that extends in a longitudinal direction and a lateral direction. A plurality of longitudinally-extending troughs are located on the base pad. Each longitudinally-extending trough has a respective channel opening that is connected to a laterally extending drain channel. A pad surface is located on the longitudinally-extending troughs, and a water-distribution feature located on the pad surface.

Another embodiment of the invention relates to a water amusement device that includes a plurality of longitudinally-extending troughs. A pad surface is located on the longitudinally-extending troughs. A first and a second water-distribution feature are located on the pad surface. Each longitudinally-extending trough has a respective channel opening that is connected to a laterally extending drain channel. A return channel connects the drain channel to a reservoir. A pump inlet is located in the reservoir and a pump outlet is adapted to supply water to a water distribution manifold. The water distribution manifold includes a first manifold outlet connected to the first water-distribution feature and a second manifold outlet connected to the second water-distribution feature. A pump is connected to the pump inlet and the pump outlet.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
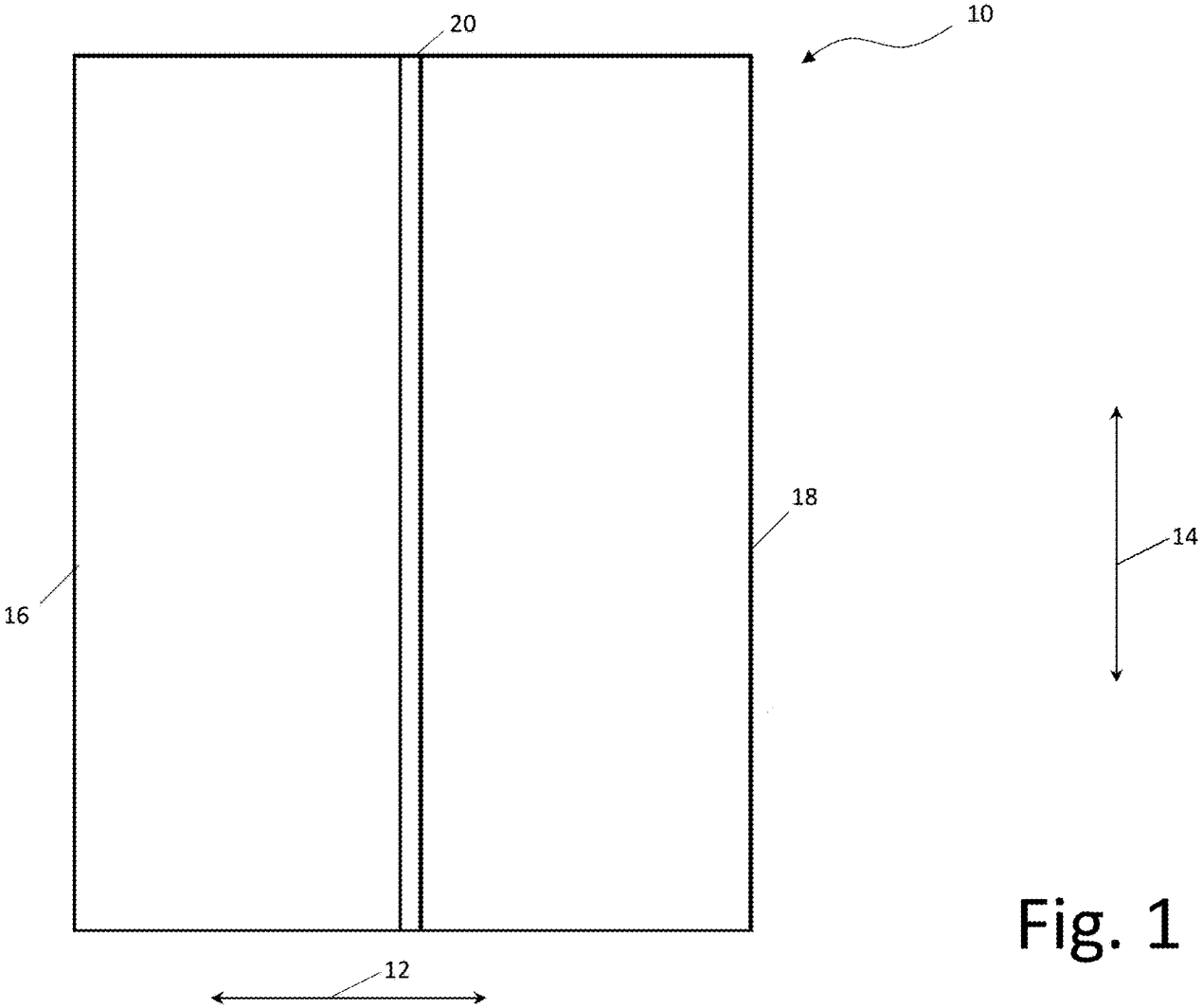
FIG. 1 is an overhead plan view of concrete base pad including a keyway and that is suitable for use with this invention.

Referring now to the drawings, there is shown in FIG. 1 an overhead plan view of a base pad, shown generally at 10. The illustrated base pad 10 is made of steel-reinforced concrete, but may be made of any desired material such as, for example, sand, crushed rock, wood, or asphalt. The illustrated base pad 10 extends in a longitudinal direction 12 for approximately twenty feet and extends in a lateral direction 14 approximately twenty four feet. However, the base pad 10 may have any desired dimensions. The illustrated base pad 10 is approximately four-inches thick but the base pad 10 may have any other desired thickness. The illustrated base pad 10 is sloped in the longitudinal direction 12, and has a high end 16 and a low end 18. The slope of the illustrated base pad 10 is approximately one-quarter-inch per foot, but the base pad 10 may have any other desired slope. The illustrated base pad 10 includes a keyway or central notch 20. The illustrated central notch 20 is approximately four inches wide in the longitudinal direction 12 and approximately two inches deep perpendicular to the surface of the base pad 10. The purpose of the central notch 20 will be described below and the central notch 20 may have other desired dimensions.

Figure 2:
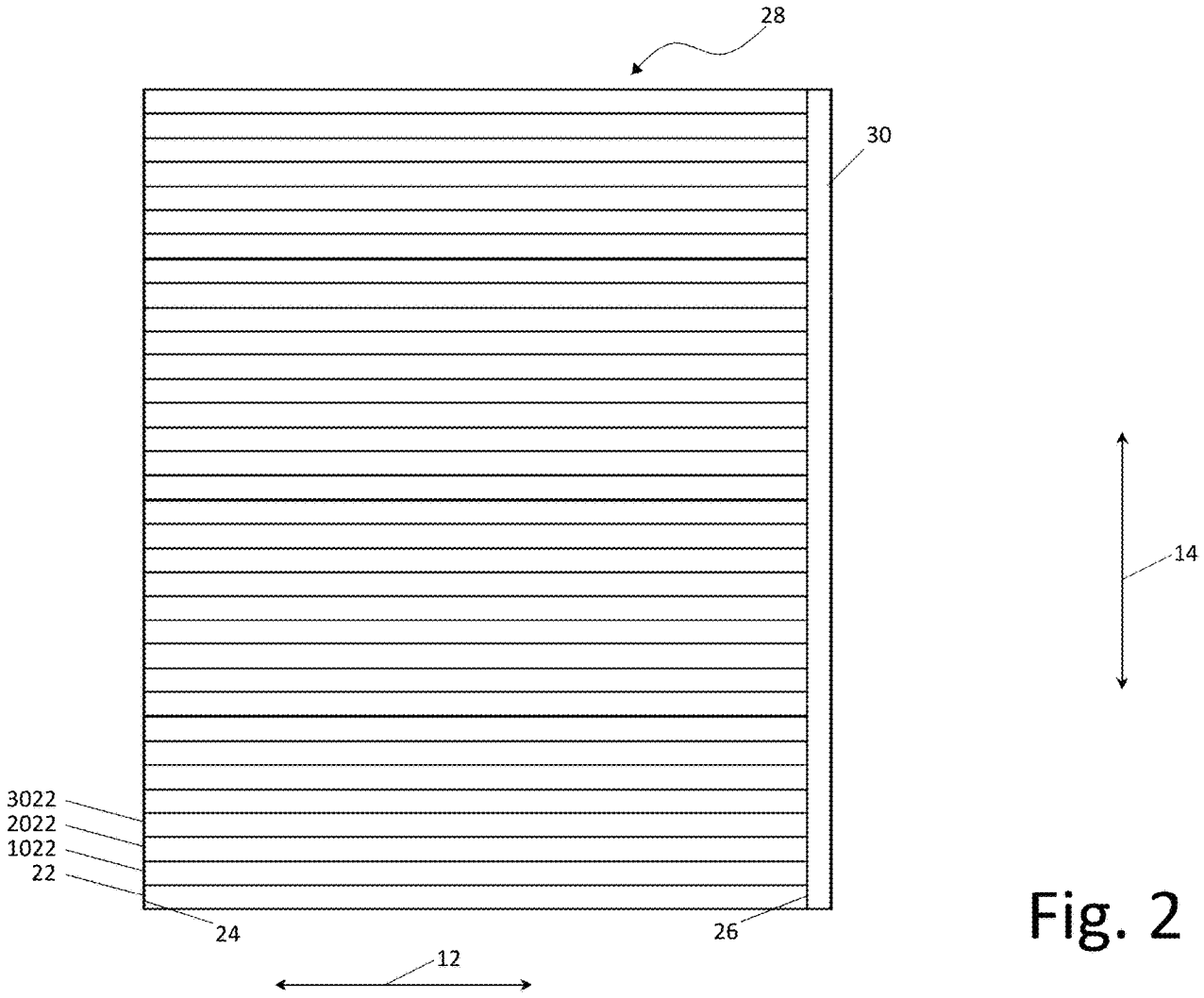
FIG. 2 is an overhead plan view similar to FIG. 1 showing a plurality of longitudinally-extending troughs installed over the base pad and a laterally-extending drain channel attached to the longitudinally-extending troughs.

Referring now to FIG. 2, an overhead plan view similar to FIG. 1 is shown including a plurality of longitudinally-extending troughs 22, 1022, 2022, 3022, etc. placed on the base pad 10. The illustrated embodiment includes twenty seven longitudinally-extending troughs, although any other desired number of longitudinally-extending troughs may be used. Only longitudinally-extending trough 22 will be described in detail, but it should be appreciated that each of the illustrated longitudinally-extending troughs is made of the same material and has substantially identical dimensions. Alternatively, one or more of the longitudinally-extending troughs may be made or different materials or may have different dimensions, if desired.

The illustrated longitudinally-extending trough 22 is made of fiberglass, but may be made of any other desired material such as, of example, concrete or extruded plastic. The illustrated longitudinally-extending trough 22 extends in the longitudinal direction 12 from a closed end 24 to a drain end 26. The illustrated closed end 24 and drain end 26 are separated by approximately twenty feet in the longitudinal direction 12. However, the longitudinally-extending trough 22 may have any desired length in the longitudinal direction 12. The illustrated longitudinally-extending trough 22 is placed on the base pad 10 (which is not visible in FIG. 2), with the closed end 24 nearest the high end 16 of the base pad 10 and the drain end 26 nearest the low end 18 of the base pad 10. Consequently, the longitudinally-extending trough 22 has a slope in the longitudinal direction 12 that is the same as the slope of the base pad 10, and the longitudinally-extending trough 22 slopes downward toward the drain end 26. It should be appreciated that instead of, or in addition to, providing a sloped base pad 10, the longitudinally-extending trough 22 may have a sloped bottom, if desired. The illustrated longitudinally-extending trough 22 has an edge-to-edge width in the lateral direction 14 of approximately ten and three-quarters inches. However, the longitudinally-extending trough 22 may have any desired lateral width. Additional details of the longitudinally-extending trough 22 will be described below in reference to the cross-sectional views.

The longitudinally-extending trough 1022 is positioned adjacent to the longitudinally-extending trough 22 in the lateral direction 14. The longitudinally-extending trough 2022 is further positioned adjacent to the longitudinally-extending trough 1022 in the lateral direction 14. Additional longitudinally-extending troughs 3022, etc. are positioned laterally adjacent to each other across the width of the base pad 10. Together, the longitudinally-extending troughs 22, 1022, 2022, 3022, etc. form a trough assembly, indicated generally at 28.

A laterally-extending drain channel 30 is attached to the trough assembly 28. The illustrated drain channel 30 is a fiberglass trough that is approximately ten-inches wide in the longitudinal direction 12. However, the drain channel 30 may be made of any desired material and may have some other desired shape or dimension. For example, the drain channel 30 may be PVC pipe. The drain channel 30 is attached to the trough assembly 28 adjacent the drain end 26 of the longitudinally-extending trough 22. Additional details of the drain channel 30 will be described below in reference to the cross-sectional views.

Figure 3:
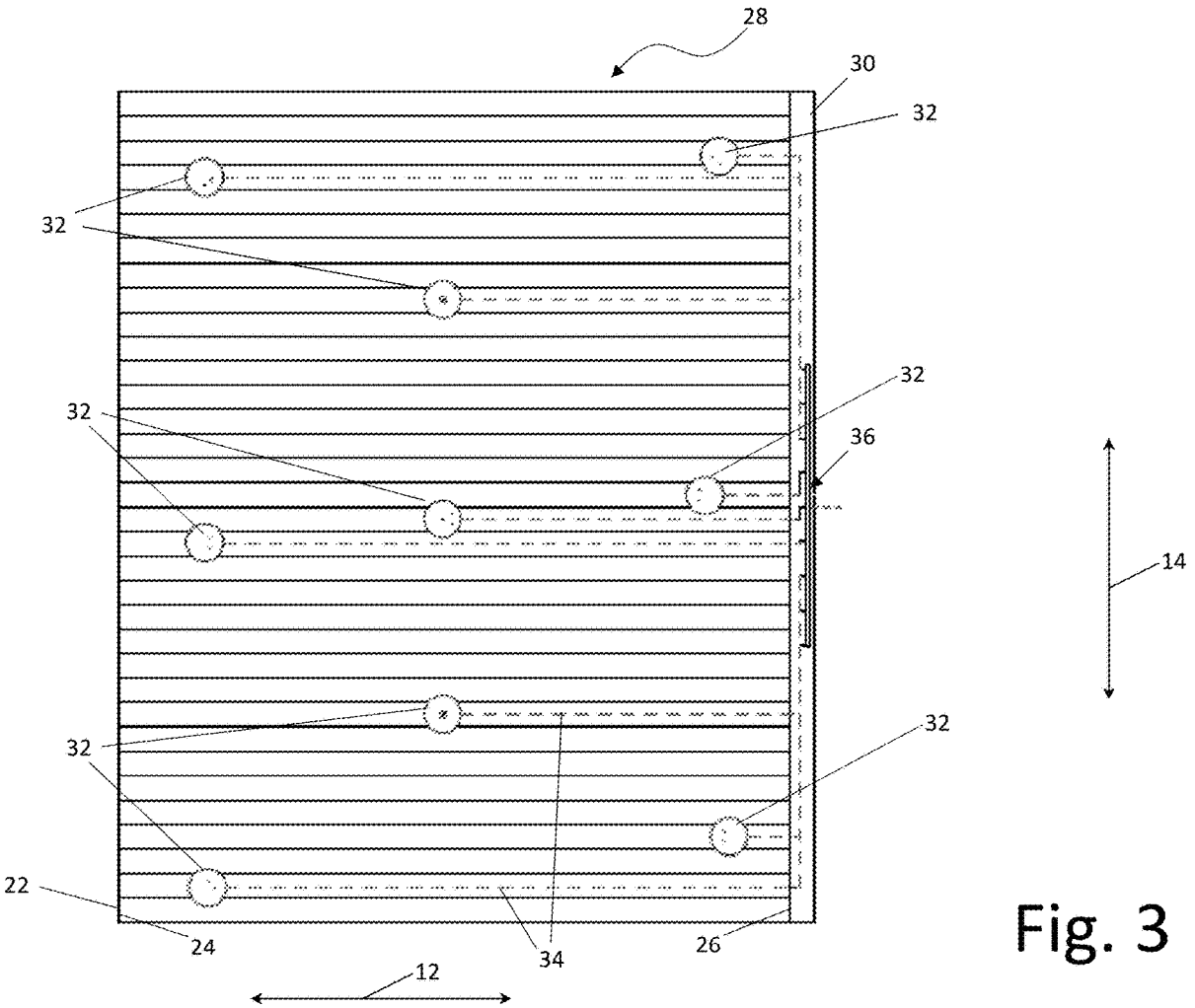
FIG. 3 is an overhead plan view similar to FIG. 2 showing a plurality of water distribution features installed on the longitudinally-extending troughs and schematically showing water supply lines and water drain line.
Figure 4:
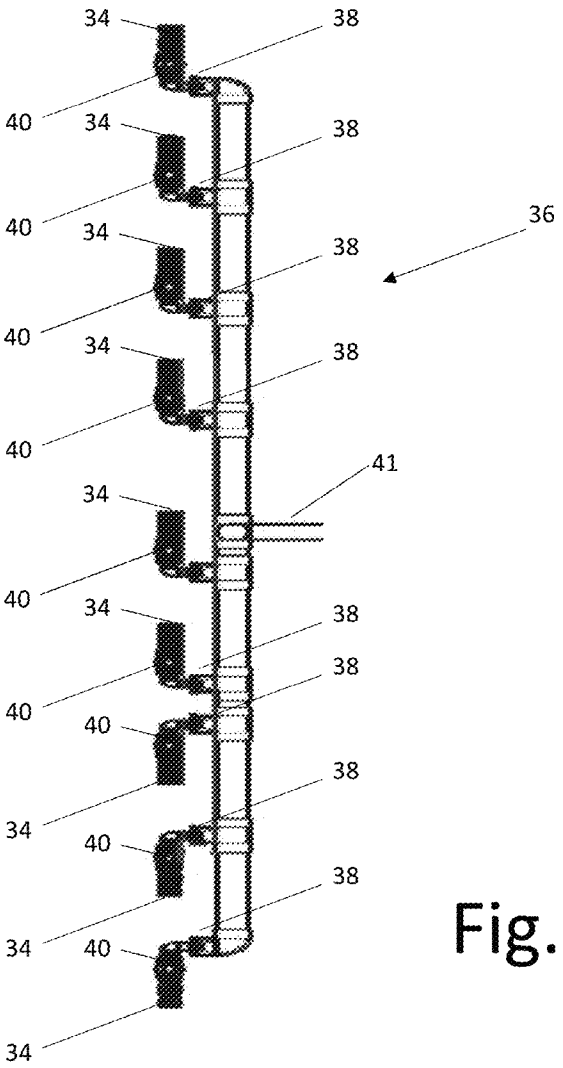
FIG. 4 is an overhead plan view of a water distribution manifold.

Referring now to FIG. 3, an overhead plan view similar to FIG. 2 is shown with a plurality of water-distribution features 32 placed over the trough assembly 28. In the illustrated embodiment, there are nine water-distribution features 32 but any other desired number of water-distribution features 32 may be provided. The water-distribution features 32 are fixtures that include one or more nozzles adapted to provide a flow or spray of water. Each of the illustrated water-distribution features 32 provides an archtype water spray, as will be described below. However, any desired type and combination of water-distribution features may be installed. Each of the water distribution features 32 is connected to a respective water supply line 34. The illustrated water supply lines 34 are made of flexible tubes, but may be made of any desired material. It should be appreciated that the size of each of the water supply lines 34 may be selected based on the desired flow rate of water to the connected water-distribution feature 32. Each of the water supply lines 34 is connected to a water distribution manifold, indicated generally at 36. The water distribution manifold 36 is shown in greater detail in FIG. 4.

The illustrated water distribution manifold 36 is made of PVC pipe and T-connections and includes a plurality of manifold outlets 38. However, the water distribution manifold 36 may be made of any desired material. Each of the manifold outlets 38 includes an associated outlet valve 40 which may be adjusted to change the flow rate of water from the water distribution manifold 36 to the respective water supply line 34. In the illustrated embodiment, the water distribution manifold 36 includes nine manifold outlets 38. However, the water distribution manifold 36 may include any desired number of manifold outlets 38, and the water distribution manifold 36 may include a number of manifold outlets 38 that is different from the number of water-distribution features 32, if desired. A pump outlet 41 is also connected to the water distribution manifold 36. The pump outlet 41 is used to provide water under pressure to the water distribution manifold 36, as will be described below. In the illustrated embodiment, the water distribution manifold 36 is located within the drain channel 30. However, the water distribution manifold 36 may be located in some other desired place.

Figure 5:
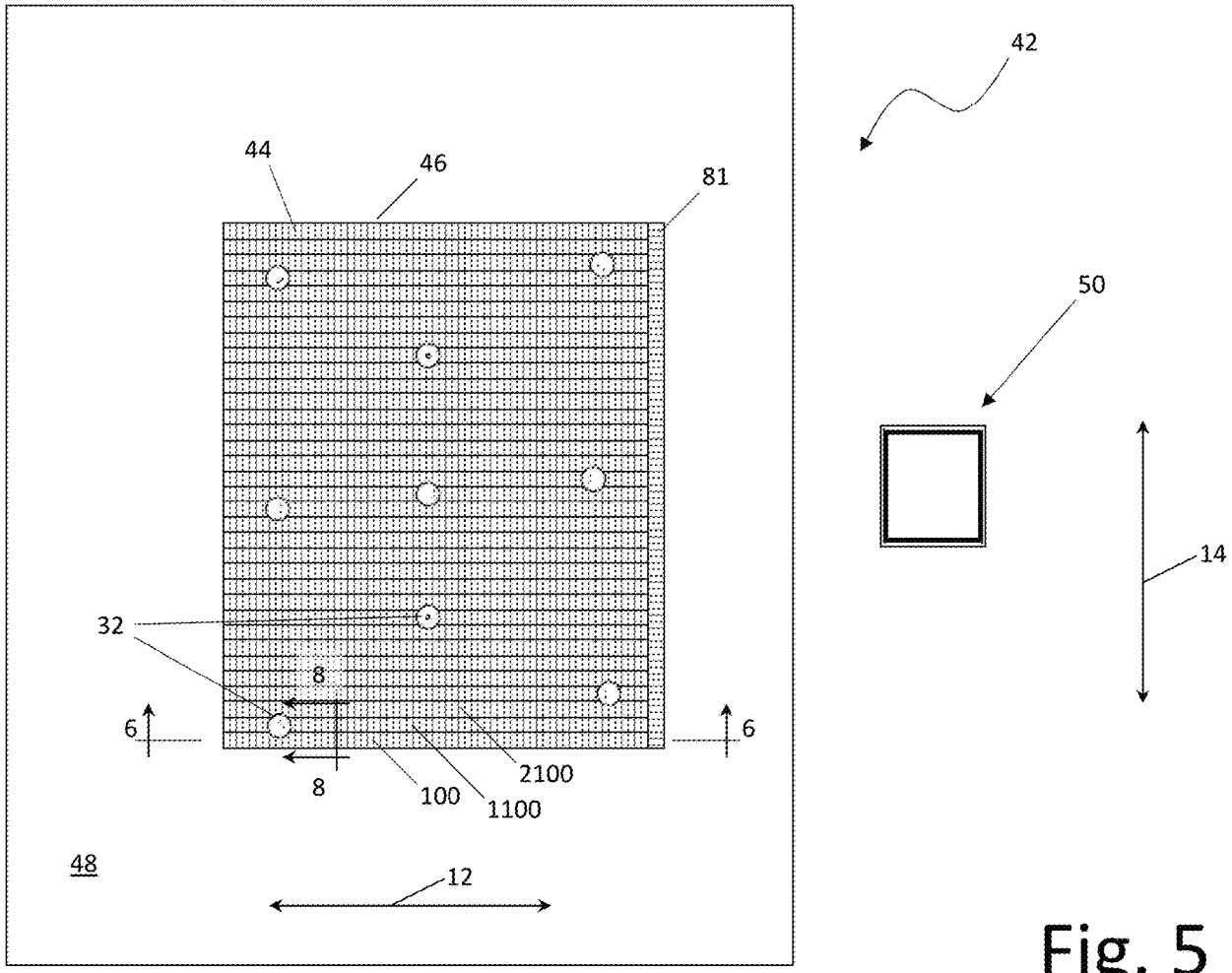
FIG. 5 is an overhead plan view of a completed and installed splash pad and water circulation vault in accordance with this invention.

Referring now to FIG. 5, an overhead plan view of a completed water amusement device, indicated generally at 42, is shown. The water amusement device 42 includes a pad surface 44 that has been installed over the trough assembly 28 to create an assembled splash pad 46. The illustrated pad surface 44 is a PVC grating, but any other desired material may be used for the pad surface 44. The pad surface 44 will be described in greater detail below in reference to the cross-sectional views. In the illustrated embodiment, the splash pad 46 is surrounded by an optional deck 48. The illustrated deck 48 is made of concrete, but may be made of any desired material. The illustrated deck 48 is sloped away from the splash pad 46 so that surface water will flow away from the splash pad 46. However, the deck 48 may have any desired slope. The water amusement device 42 also includes a water circulation vault, indicated generally at 50, that is used to collect water from the drain channel 30 and to provide water to the water distribution manifold 36, as will be described below.

Figure 6:
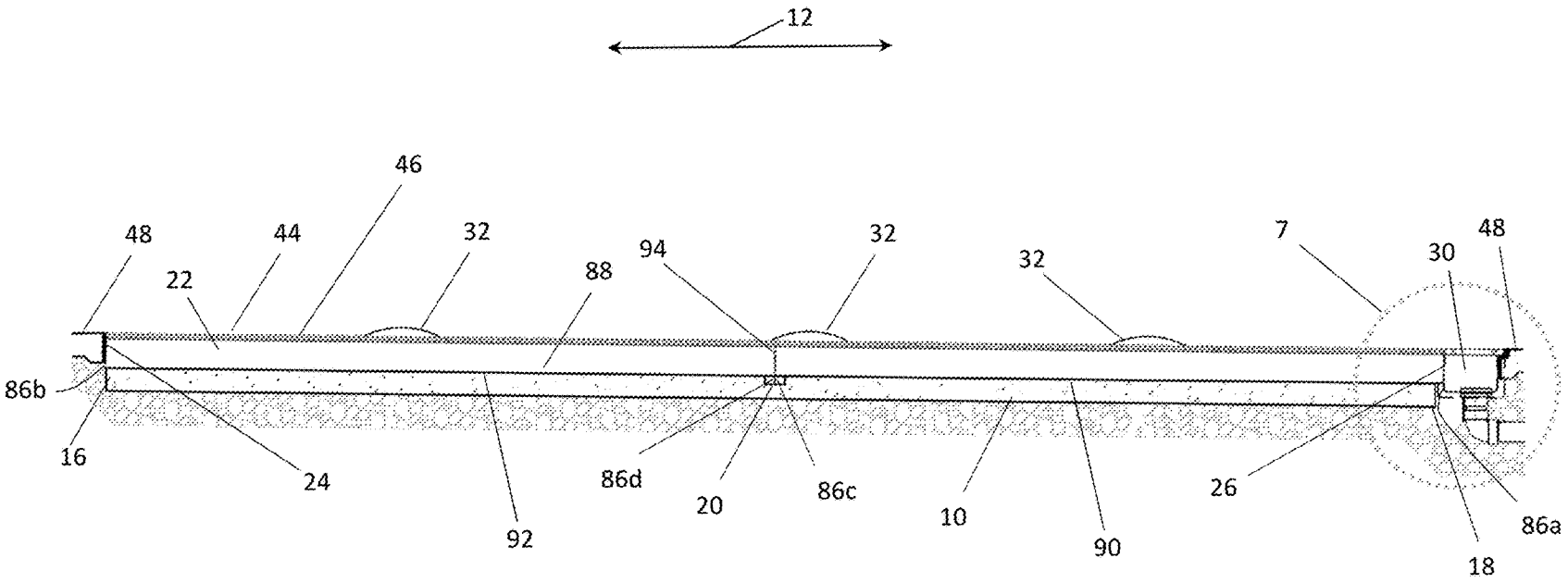
FIG. 6 is a cross-sectional view of the installed splash pad taken along line 6-6 of FIG. 5.
Figure 7:
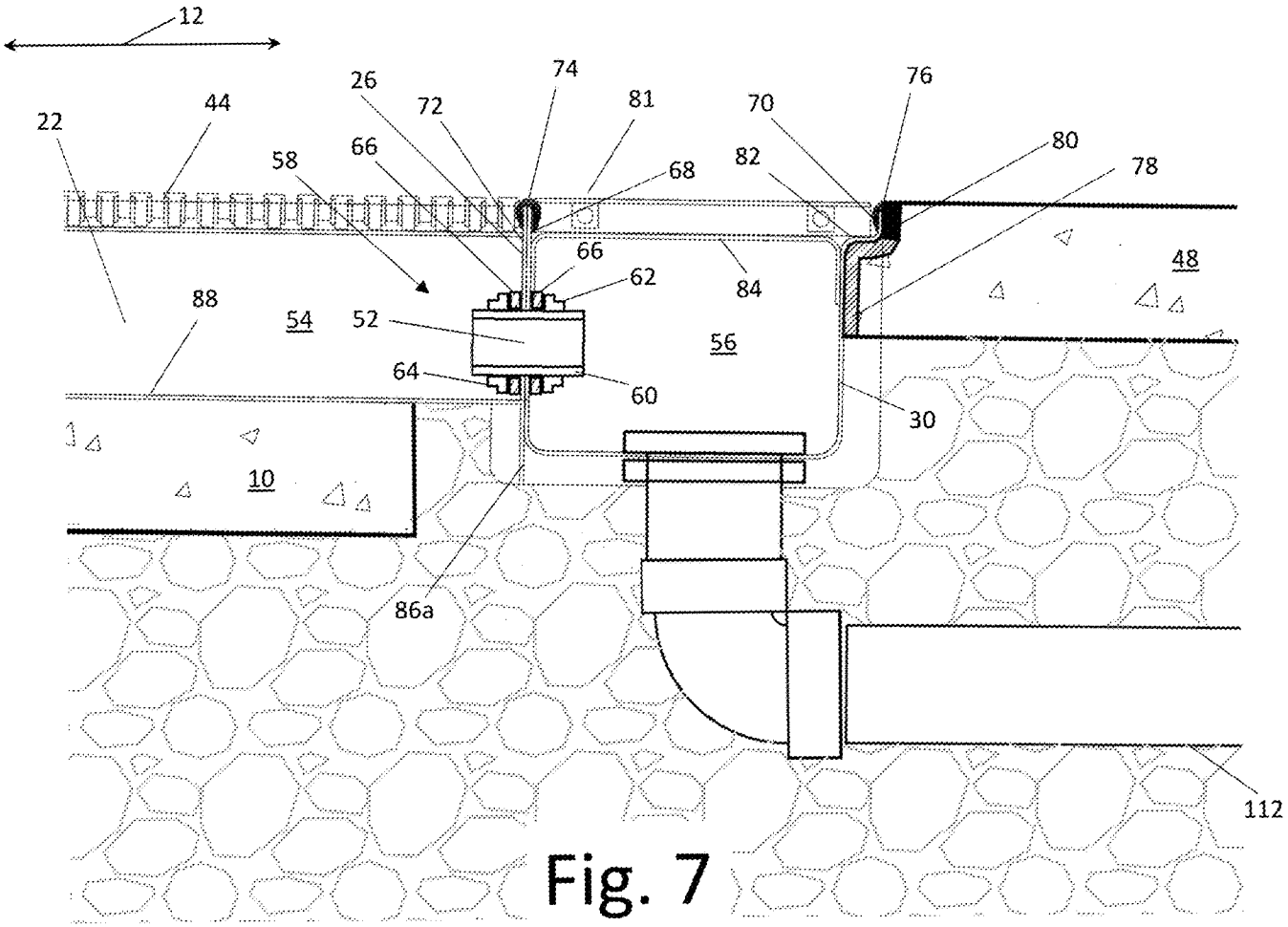
FIG. 7 is a detailed view of area 7 in FIG. 6.

Referring now to FIG. 6, a cross-sectional view of the splash pad 46 is shown, taken along line 6-6 of FIG. 5, along the centerline of longitudinally-extending trough 22. FIG. 7 is a detailed view of the area 7 around the drain channel 30. In the illustrated embodiment, the longitudinally-extending trough 22 abuts the drain channel 30. As previously described, the longitudinally-extending trough 22 slopes downward toward the drain end 26. Therefore, water in the longitudinally-extending trough 22 will tend to flow to the drain end 26. A channel opening 52 connects a trough interior 54 of longitudinally-extending trough 22 to a drain interior 56 of the drain channel 30 and allows water to flow from the longitudinally-extending trough 22 into the drain channel 30. The illustrated channel opening 52 includes a generally circular hole in the drain end 26 of the longitudinally-extending trough 22 and an aligned, generally circular hole in the drain channel 30. However, the channel opening 52 may have some other shape or configuration, if desired. In the illustrated embodiment, each of the longitudinally-extending troughs includes a respective channel opening 52 to allow water to flow directly into to the drain channel 30. However, this is not necessary, and some longitudinally-extending troughs may not include a channel opening. Rather, those longitudinally-extending troughs could include an opening (not shown) to allow water to drain into an adjacent longitudinally-extending trough, and from there into the drain channel 30.

As shown in FIG. 7, the illustrated channel opening 52 includes a channel fitting, indicated generally at 58. The illustrated channel fitting 58 includes a pipe segment 60 that extends in the longitudinal direction 12 from the drain interior 56, through the channel opening 52, and into the trough interior 54. The channel fitting 58 also includes a drain nut 62 that is located in the drain interior 56 and is attached to the pipe segment 60, and a trough nut 64 that is located in the trough interior 54 and is attached to the pipe segment 60. In the illustrated embodiment, the pipe segment 60 is a piece of PVC pipe, threaded at each end, and the drain nut 62 and trough nut 64 are both PVC nuts that are threaded onto the pipe segment 60. However, the channel fitting 58 may be made of other desired materials. Optional seals 66 are provided around the pipe segment 60 and help prevent water from escaping through the space between the drain end 26 of the longitudinally-extending trough 22 and the drain channel 30. The channel fitting 58 provides multiple benefits for the splash pad 46. The channel fitting 58 helps to maintain the proper alignment between the longitudinally-extending trough 22 and the drain channel 30. The channel fitting 58 will help resist relative movement between the longitudinally-extending trough 22 and the drain channel 30 in the longitudinal direction 12, the lateral direction 14, or any other direction. Additionally, it should be appreciated that the channel fitting 58 will help resist relative rotation between the longitudinally-extending trough 22 and the drain channel 30 about an axis parallel to the longitudinal direction 12, as well as about an axis parallel to the latitudinal direction 14, particularly when multiple channel fittings are installed along the length of the drain channel 30.

The drain channel 30 includes an inner edge 68 and an opposed outer edge 70. The inner edge 68 is positioned adjacent to a drain edge 72 of the longitudinally-extending trough 22. It should be appreciated that the drain edge 72 is the upper edge of the drain end 26. An edge trim 74 is applied to the inner edge 68 and the drain edge 72. The illustrated edge trim 74 has a generally C-shaped cross section and engages both the inner edge 68 and the drain edge 72. The illustrated edge trim 74 is made of rubber, but may be made of any desired material. The edge trim 74 extends the entire lateral width of the drain channel 30 and provides multiple benefits to the splash pad 46. As previously described, the drain channel 30 and the longitudinally-extending trough 22 are made of fiberglass, and the edge trim 74 provides a cover for any potentially sharp or hard edges. Additionally, the edge trim 74 helps to hold the drain channel 30 and the trough assembly 28 together and further helps resist relative movement between the longitudinally-extending trough 22 and the drain channel 30. The outer edge 70 includes an outer edge trim 76 that may be made of the same material as the edge trim 74. The illustrated outer edge trim 76 is only applied to the outer edge 70 and is not engaged with any other component of the splash pad 46.

The outer edge 70 of the drain channel 30 is located adjacent to the deck 48. As previously described, the illustrated deck 48 is made of concrete, and an optional spacer 78 is provided between the drain channel 30 and the deck 48. The illustrated spacer 78 is made of half-inch thick polyethylene foam, but may be made of other desired materials. The spacer 78 is provided to allow for some relative movement of the splash pad 46 relative to the deck 48 without damage to the splash pad 46. An optional spacer seal 80 is provided above the spacer 78 to help prevent surface water from infiltrating into the space between the drain channel 30 and the deck 48. The illustrated spacer seal 80 is a bead of caulk, but any desired material may be used.

The drain channel 30 supports a portion of the pad surface 44. As best seen in FIG. 5, the illustrated pad surface 44 includes a laterally-extending portion 81 that is disposed over the drain channel 30. As previously described, the illustrated pad surface 44 is made of a PVC grating which will allow water on the laterally-extending portion 81 of the pad surface 44 to flow through into the drain interior 56 of the drain channel 30. Referring back to FIG. 7, the laterally-extending portion 81 of the pad surface 44 is supported on a lip 82 on the drain channel 30 and by a support arm 84 that is fastened to the drain channel 30. The illustrated laterally-extending portion 81 is approximately ten-inches wide, but may have any desired width. The illustrated laterally-extending portion 81 of the pad surface 44 is comprised of multiple separate PVC grate sections, and the drain channel 30 includes multiple support arms 84 along its lateral length so that each PVC grate section is supported by two or more support arms 84.

As also shown in FIG. 7, the longitudinally-extending trough 22 includes a flange 86*a*. The illustrated flange 86*a* extends approximately two inches below a lower surface 88 of the longitudinally-extending trough 22. Referring back to FIG. 6, the longitudinally-extending trough 22 includes an opposed flange 86*b* at the opposed, closed end 24. The illustrated twenty-foot long longitudinally-extending trough 22 is made from a first ten-foot long section 90 and a second ten-foot long section 92 that meet end-to-end at a joint 94. The first ten-foot long section 90 includes the flange 86*a* at one end and a first intermediate flange 86*c* at the opposed end. The second ten-foot long section 92 includes the opposed flange 86*b* at one end and a second intermediate flange 86*d* at the opposed end. The first ten-foot long section 90 and the second ten-foot long section 92 are positioned on the base pad 10 such that the first intermediate flange 86*c* and the second intermediate flange 86*d* are adjacent to each other and extend below the lower surface 88 of the longitudinally-extending trough 22 into the central notch 20 in the base pad 10. It should be appreciated that the described two sections 90 and 92 comprising the longitudinally-extending trough 22 is only one way in which the longitudinally-extending trough 22 may be manufactured, and it may alternatively be made as a single piece, or as more than two pieces, if desired.

Figure 8:
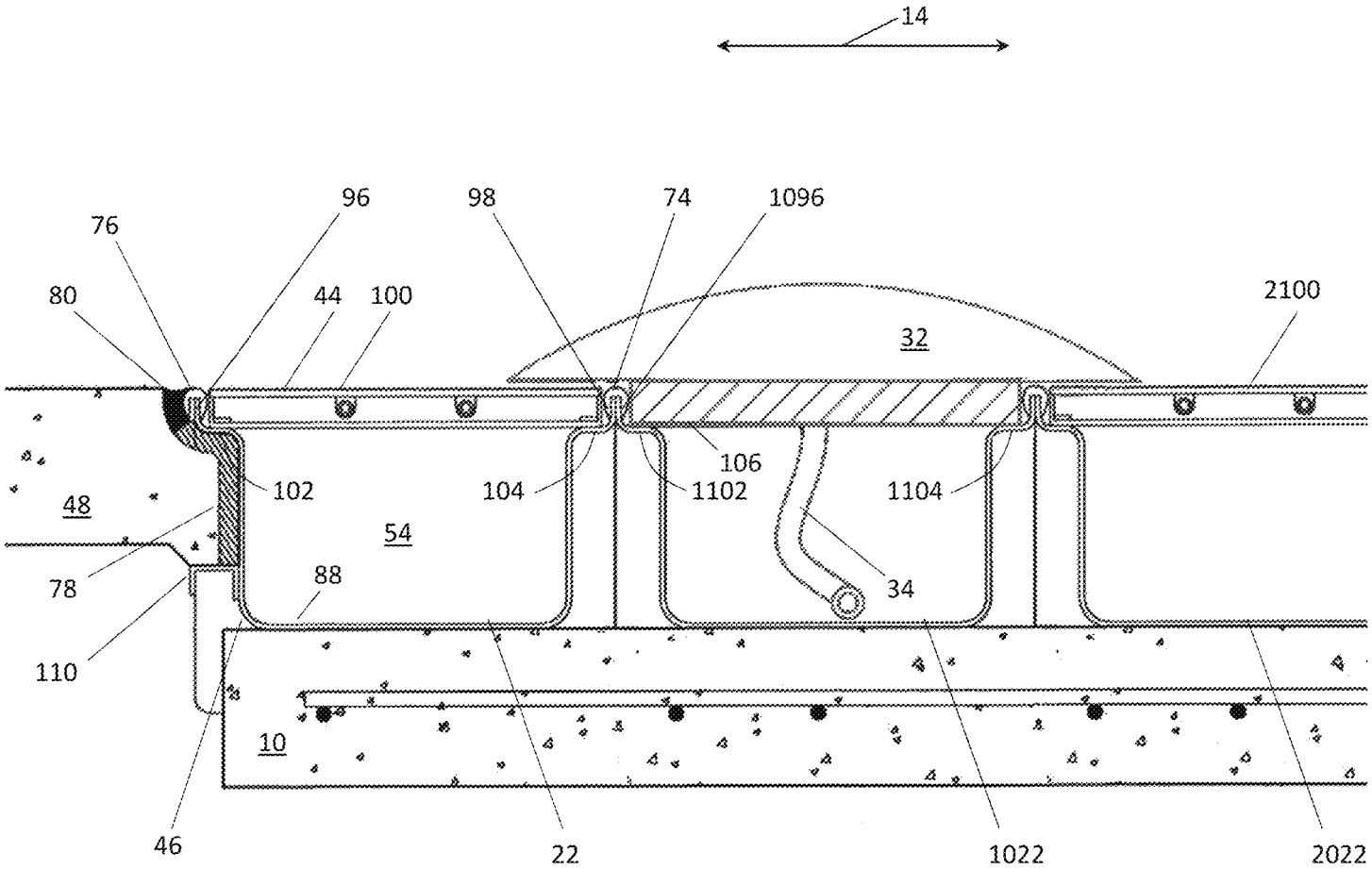
FIG. 8 is a cross-sectional view of a portion of the installed splash pad taken along line 8-8 of FIG. 5.

Referring now to FIG. 8, a cross-sectional view of the splash pad 46 taken along line 8-8 of FIG. 5 is shown. The longitudinally-extending trough 22 includes a first edge 96 and an opposed second edge 98. In the illustrated embodiment, the first edge 96 is an outer edge of the splash pad 46. The first edge 96 includes the outer edge trim 76. Additionally, the first edge 96 is located adjacent to the deck 48. As previously described, the illustrated deck 48 is made of concrete, and the optional spacer 78 is provided between the longitudinally-extending trough 22 and the deck 48. The optional spacer seal 80 is provided above the spacer 78 to help prevent surface water from infiltrating into the space between the longitudinally-extending trough 22 and the deck 48.

The second edge 98 of the longitudinally-extending trough 22 is positioned adjacent to a first edge 1096 of the second longitudinally-extending trough 1022. The edge trim 74 is applied to the second edge 98 and the first edge 1096. The edge trim 74 extends the whole longitudinal length of the longitudinally-extending trough 22 and the second longitudinally-extending trough 1022. As previously described, the edge trim 74 provides a protective cover for the second edge 98 and the first edge 1096, and also helps to resist relative movement between the longitudinally-extending trough 22 and the second longitudinally-extending trough 1022.

The longitudinally-extending trough 22 supports a portion of the pad surface 44. As best seen in FIG. 5, the illustrated pad surface 44 includes a plurality of longitudinally-extending portions 100, 1100, 2100, etc. that is disposed over the longitudinally-extending troughs 22, 1022, 2022, etc. As previously described, the illustrated pad surface 44 is made of a PVC grating, which will allow water on the longitudinally-extending portion 100 of the pad surface 44 to flow through into the trough interior 54 of the longitudinally-extending trough 22. Referring back to FIG. 8, the longitudinally-extending portion 100 of the pad surface 44 is supported on a first lip 102 and an opposed, second lip 104 on the longitudinally-extending trough 22. The illustrated longitudinally-extending portion 100 is approximately ten-inches wide, but may have any desired width. The illustrated longitudinally-extending portion 100 of the pad surface 44 is comprised of multiple separate PVC grate sections.

One of the water-distribution features 32 is visible in FIG. 8. As shown, the water-distribution feature 32 is mounted on a feature pad 106. The illustrated feature pad 106 is a sheet of PVC material, but may be made of any desired material. The feature pad 106 has the same width as the longitudinally-extending portion 100 of the pad surface 44, and as shown is supported on a first lip 1102 and an opposed, second lip 1104 of the second longitudinally-extending trough 1022. It should be appreciated that the feature pad 106 may be installed in place of one or more PVC grate sections that comprise a second longitudinally-extending portion 1100. Optional fasteners (not shown) may be used to fix the feature pad 106 relative to the second longitudinally-extending trough 1022. In the illustrated embodiment, the fasteners are stainless steel screws, but any desired fastener may be used. It should be appreciated that the position of the water-distribution features 32 on the splash pad 46 may be changed by removing the feature pad 106 and placing it in a different, desired location. Also, it should be appreciated that the water supply line 34 travels from the water distribution manifold 36 to the water-distribution feature 32 by passing through the channel fitting and the channel opening connected to whichever longitudinally-extending trough the water-distribution feature 32 is located on. Since the illustrated embodiment uses flexible tube for the water supply line 34, one of the water-distribution features 32 may be moved to a different longitudinally-extending trough, and the associated water supply line 34 may be relatively easily rerouted into that longitudinally-extending trough.

As also shown in FIG. 8, the splash pad 46 includes an optional edge flange 110. The edge flange 110 projects outwardly from the side of the splash pad 46 and is located below the deck 48. This allows the weight of the deck 48 to help prevent the splash pad 46 from moving upwards relative to the deck 48.

Referring back to FIG. 7, a return channel 112 is connected to the drain channel 30. The illustrated return channel 112 is a three-inch diameter PVC pipe but the return channel 112 may be made of any desired material. The return channel 112 is sloped downward from the drain channel 30 to the water circulation vault 50 (shown in FIG. 5).

Figure 9:
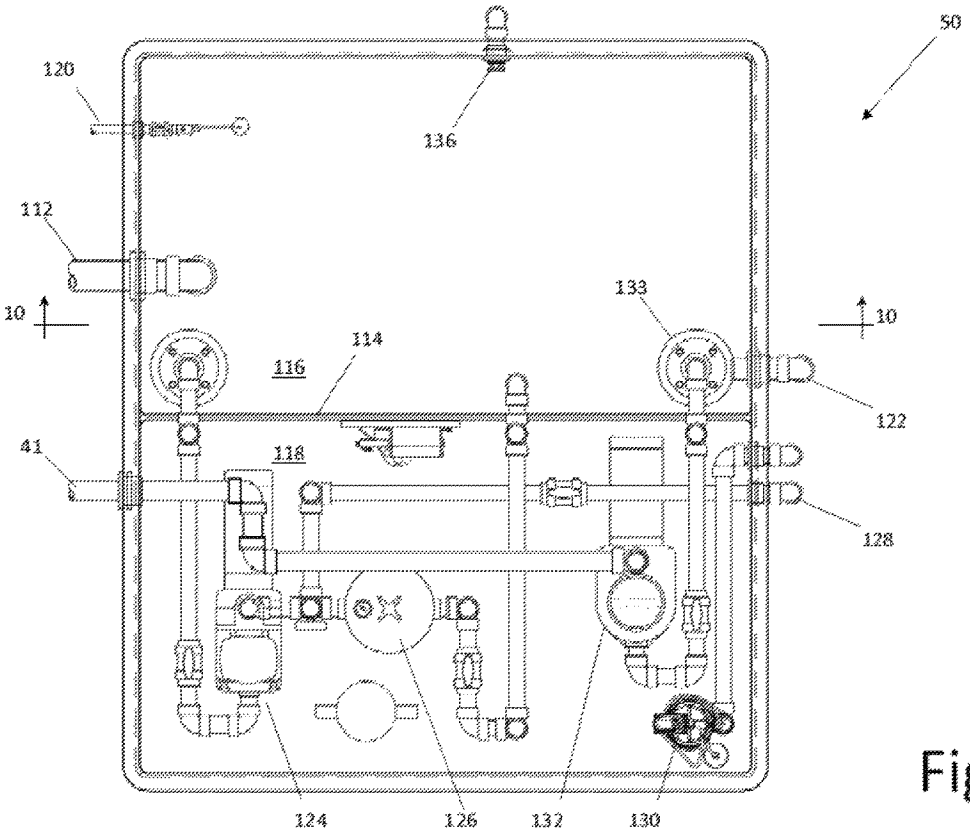
FIG. 9 is an overhead plan view of the installed water circulation vault shown with a cover removed so that a water filtration and circulation mechanical system is visible.

Referring now to FIG. 9, an overhead plan view of the water circulation vault 50 is shown. The illustrated water circulation vault 50 is a fiberglass basin, but may be made of any desired material. The illustrated water circulation vault 50 is a single unit, but may be made of multiple units if desired. The illustrated water circulation vault 50 is divided by an internal wall 114 into a reservoir 116 and a mechanical space 118. As shown, the return channel 112 discharges into the reservoir 116, and allows water from the drain channel 30 to gravity flow into the reservoir 116. Alternatively, the water from the drain channel 30 may be pumped into the reservoir 116 if desired. The illustrated water circulation vault 50 includes a make-up water inlet 120 which is adapted to automatically add water from a water source (not shown) to the reservoir 116 if the water level in the reservoir 116 falls below a desired minimum depth. The illustrated water circulation vault 50 includes an overflow outlet 122 that allows water to flow from the reservoir 116 to the outside of the water circulation vault 50 if the water level in the reservoir 116 exceeds a desired maximum depth.

The illustrated mechanical space 118 includes a recirculation pump 124 and a filter 126. The recirculation pump 124 draws water from the reservoir 116, runs it through the filter 126, and discharges it back into the reservoir 116. The filter 126 may be any desired type of filter or filtration unit. Optionally, flow from the recirculation pump 124 may be rerouted to a pump-out discharge 128 in order to pump water from the reservoir 116 to the outside of the water circulation vault 50. The mechanical space 118 includes a sump pump 130 that may be used to pump water from the mechanical space 118 to the outside of the water circulation vault 50. The mechanical space 118 also includes a feature pump 132 that may be used to draw water into a pump inlet 133 from the reservoir 116 and pump it into the pump outlet 41. As previously described, the manifold supply line 41 then provides the water under pressure to the water distribution manifold 36.

Figure 10:
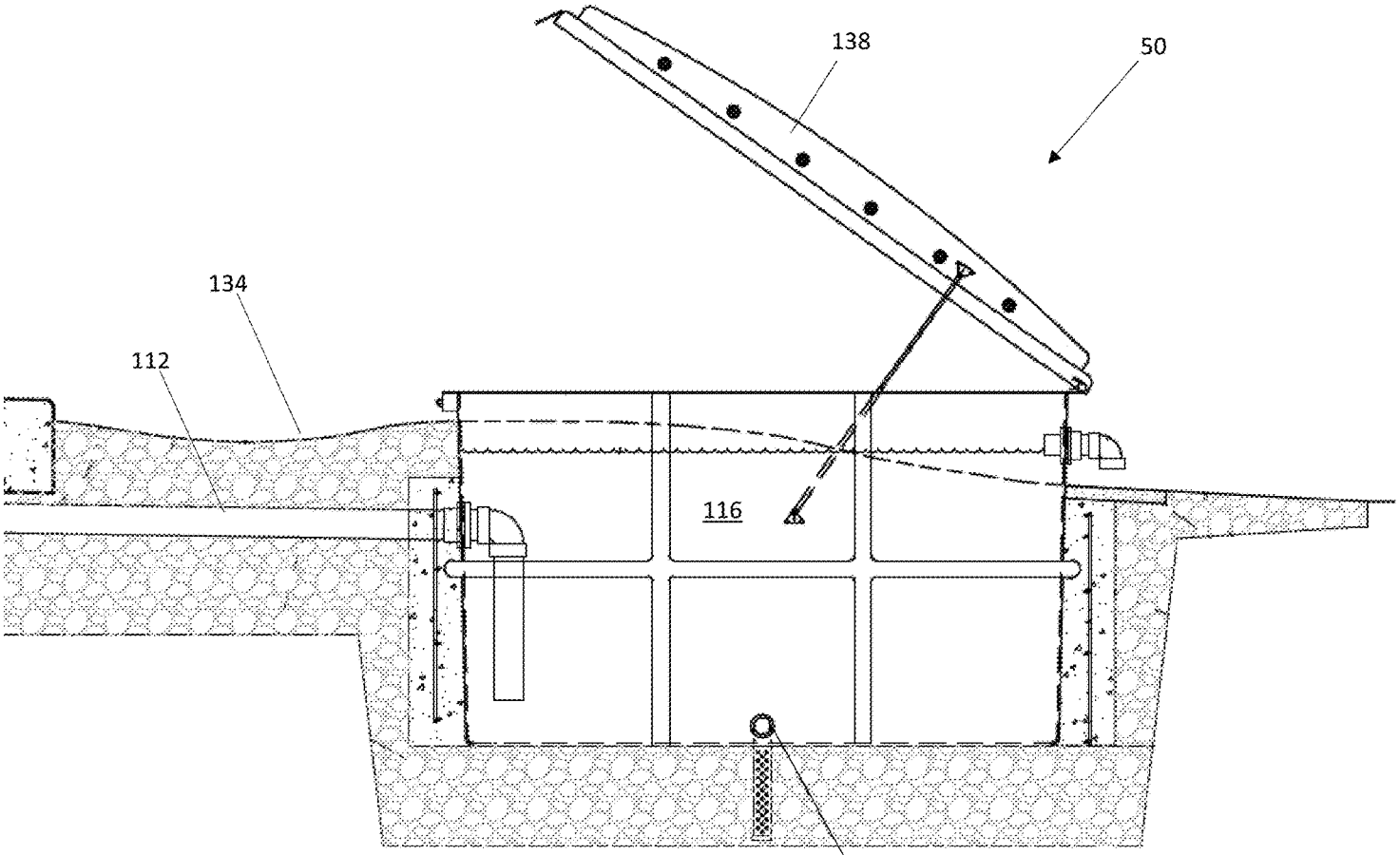
FIG. 10 is a cross-sectional view of the installed water circulation vault taken along line 10-10 of FIG. 9.

Referring now to FIG. 10, a cross-sectional view of the water circulation vault 50 taken along line 10-10 of FIG. 9 is shown. This cross-sectional view is taken through the reservoir 116 of the water distribution vault 50. As shown, the illustrated water circulation vault 50 is located partially below a ground surface 134. Additionally, the return channel 112 is located below the ground surface 134 from the drain channel 30 to the water distribution vault 50. Although not visible in FIG. 10, it should be appreciated that the pump outlet 41 is also located below the ground surface 134 from the water distribution vault 50 to the splash pad 46. Alternatively, the water distribution vault 50 or any related components may be located above the ground surface 134, if desired. The water distribution vault 50 includes a hydrostatic relief valve 136. The hydrostatic relief valve 136 is normally closed, but will open if the water pressure outside the water distribution vault 50 is greater than the water pressure in the reservoir 116. When the hydrostatic relief valve 136 is open, it allows water from outside the water distribution vault 50 to flow into the reservoir 116. This helps to prevent ground water surrounding the water distribution vault 50 from causing the water distribution vault 50 to float relative to the ground surface 134. The illustrated water distribution vault 50 includes a hinged cover 138 that may be raised to provide access to the reservoir 116 and the mechanical space 118. Alternatively, the water distribution vault 50 may include more than one cover, if desired.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A water amusement device comprising:

a base pad that extends in a longitudinal direction and a lateral direction;

a plurality of longitudinally-extending troughs located on the base pad;

each longitudinally-extending trough having a respective channel opening that is connected to a laterally extending drain channel;

a pad surface located on the longitudinally-extending troughs; and a water-distribution feature located on the pad surface.

2. The water amusement device of claim 1, further comprising:

a return channel that connects the drain channel to a reservoir, the return channel adapted so that water will flow from the drain channel to the reservoir;

a pump inlet located in the reservoir;

a pump outlet adapted to supply water to the water-distribution feature; and a pump connected to the pump inlet and the pump outlet.

3. The water amusement device of claim 2, wherein the reservoir is located in a vault and the pump is located in a mechanical space that is in the vault.

4. The water amusement device of claim 2, wherein the water-distribution feature is a first water-distribution feature and further comprising a second water-distribution feature; and a water distribution manifold, that includes a first manifold outlet connected to the first water-distribution feature and a second manifold outlet connected to the second water-distribution feature, wherein the pump outlet is connected to the water distribution manifold.

5. The water amusement device of claim 4, wherein the water distribution manifold is located within the laterally extending drain channel.

6. The water amusement device of claim 5, wherein the laterally extending drain channel is a laterally-extending trough and the pad surface extends over the laterally-extending trough.

7. The water amusement device of claim 1, wherein the longitudinally-extending troughs include respective upper lips that support the pad surface.

8. The water amusement device of claim 1, wherein the longitudinally-extending troughs include respective upper edges, and further comprising an edge trim that engages the upper edges of adjacent longitudinally-extending troughs.

9. The water amusement device of claim 1, wherein the base pad has a slope in the longitudinal direction and the laterally extending drain channel is located nearer a lower end of the base pad.

10. The water amusement device of claim 1, wherein the longitudinally-extending troughs slope in the longitudinal direction and the laterally extending drain channel is located adjacent a lower end of the longitudinally-extending troughs.

11. The water amusement device of claim 1, wherein the pad surface is divided into a plurality of longitudinally extending pad segments, and each longitudinally extending pad segment is supported on a different one of the longitudinally-extending troughs.

12. The water amusement device of claim 1, wherein the respective channel openings comprise a pipe segment that extends into the respective longitudinally-extending trough and the laterally extending drain channel, a first fitting attached to the pipe segment and located in the respective longitudinally-extending trough, and a second fitting attached to the pipe segment and located in the laterally extending drain channel.

13. The water amusement device of claim 1, wherein the water-distribution feature is mounted to a feature base and the feature base is supported on one longitudinally-extending trough.

14. A water amusement device comprising:

a plurality of longitudinally-extending troughs;

a pad surface located on the longitudinally-extending troughs;

a first water-distribution feature located on the pad surface and a second water-distribution feature located on the pad surface;

each longitudinally-extending trough having a respective channel opening that is connected to a laterally extending drain channel;

a return channel that connects the drain channel to a reservoir;

a pump inlet located in the reservoir;

a pump outlet adapted to supply water to a water distribution manifold that includes a first manifold outlet connected to the first water-distribution feature and a second manifold outlet connected to the second water-distribution feature; and a pump connected to the pump inlet and the pump outlet.

15. The water amusement device of claim 14, wherein the return channel is adapted so that water will flow from the drain channel to the reservoir.

16. The water amusement device of claim 14, wherein the laterally extending drain channel is a laterally-extending trough and the pad surface extends over the laterally-extending trough and the water distribution manifold is located within the laterally extending drain channel.

17. The water amusement device of claim 14, wherein the longitudinally-extending troughs include respective upper lips that support the pad surface.

18. The water amusement device of claim 14, wherein the longitudinally-extending troughs include respective upper edges, and further comprising an edge trim that engages the upper edges of adjacent longitudinally-extending troughs.

19. The water amusement device of claim 14, wherein the respective channel openings comprise a pipe segment that extends into the respective longitudinally-extending trough and the laterally extending drain channel, a first fitting attached to the pipe segment and located in the respective longitudinally-extending trough, and a second fitting attached to the pipe segment and located in the laterally extending drain channel.

20. The water amusement device of claim 14, wherein the water-distribution feature is mounted to a feature base and the feature base is supported on one longitudinally-extending trough.

* * * * *